US006554902B2

(12) United States Patent
Yan

(10) Patent No.: US 6,554,902 B2
(45) Date of Patent: Apr. 29, 2003

(54) DEVICE FOR PAINTING WALL MEMBERS OR CORNER STRAPS

(76) Inventor: Ruey Fwu Yan, P.O. Box 63-99, Taichung (TW), 406

( * ) Notice: Subject to any disclaimer, the term of this patent is extended or adjusted under 35 U.S.C. 154(b) by 64 days.

(21) Appl. No.: 09/903,507

(22) Filed: Jul. 13, 2001

(65) Prior Publication Data

US 2003/0009836 A1 Jan. 16, 2003

(51) Int. Cl.[7] ..... B05C 17/10

(52) U.S. Cl. ..... 118/264; 118/266; 15/209.1; 15/210.1; 401/139; 401/266

(58) Field of Search ..... 118/264, 266; 15/209.1, 210.1; 401/139, 266; 427/429

(56) References Cited

U.S. PATENT DOCUMENTS 2,810,148 A * 10/1957 Wood, Jr. ..... 15/210.1
3,359,589 A * 12/1967 Moore ..... 15/210.1
3,708,821 A * 1/1973 Chase et al. ..... 15/210.1
3,918,820 A * 11/1975 Kim ..... 401/152
4,250,586 A * 2/1981 Timian ..... 15/22.1
4,424,603 A * 1/1984 Balint et al. ..... 15/210.1
5,117,527 A * 6/1992 Milkie ..... 15/210.1
5,495,635 A * 3/1996 Williams ..... 15/210.1

* cited by examiner

*Primary Examiner*—Laura Edwards

(57) ABSTRACT

A painting device includes a scrubbing material secured to a board for being applied with a painting material. A device may be used for moving the board and the scrubbing material along a supporting surface, such as the corner strap. The scrubbing material may be adjusted relative to the board for being adjusted relative to the surfaces to be painted. One or more wheels may be used for facilitating the movement of the scrubbing material along the floor. A handle may be secured to the board or the scrubbing material for moving the scrubbing material along the corner strap.

6 Claims, 5 Drawing Sheets

DEVICE FOR PAINTING WALL MEMBERS OR CORNER STRAPS

BACKGROUND OF THE INVENTION

1. Field of the Invention

The present invention relates to a painting device, and more particularly to a painting device for easily and quickly painting the corner straps of the houses or buildings.

2. Description of the Prior Art

Typical painting devices are normally painted or operated by specialized persons and may not be easily used by the users at home. Particularly, the corner straps are located in the lower or bottom portion of the walls and located right above the floors, such that the users have to bow and to paint the corner straps, and such that the corner straps may not be painted with a straight configuration or shape. The corner straps thus may not be easily painted by the users themselves and should be painted by the specialized persons.

The present invention has arisen to mitigate and/or obviate the afore-described disadvantages of the conventional painting devices.

SUMMARY OF THE INVENTION

The primary objective of the present invention is to provide a painting device for easily and quickly painting the corner straps of the houses or buildings by the users without specialized persons.

The other objective of the present invention is to provide a painting device including a scrubbing material that may be easily and quickly adjusted relative to a surface to be painted.

The further objective of the present invention is to provide a painting device including a wheel device for engaging with the supporting surface and for facilitating the movement of the scrubbing material relative to or along the surface to be painted.

In accordance with one aspect of the invention, there is provided a painting device comprising a board, a scrubbing material, a device provided for securing the scrubbing material to the board, the scrubbing material being moved together with the board and provided for being applied with a painting material thereon, and another device provided for moving the board and the scrubbing material along a supporting surface.

The securing device includes a plate secured to the board for supporting the scrubbing material. The board includes an opening formed therein, the moving device includes a handle engaged through the opening of the board and secured to the plate for moving the board and the scrubbing material along the supporting surface. The handle may be used to move the scrubbing material along the wall, particularly along the corner strap, for easily and quickly painting the corner strap by the users without specialized persons.

A device is further provided for adjusting the plate and the scrubbing material relative to the board, and includes at least one groove formed in the board, and at least one fastener secured to the plate and slidably received in the at least one groove of the board for adjustably securing the plate to the board.

A wheel device is further provided for facilitating the moving of the board and the scrubbing material along the supporting surface, and includes at least one wheel rotatably and directly secured to the board, or indirectly secured to the board with at least one panel, and extended downward beyond the board for engaging with the supporting surface. The wheel device may facilitate or allow the scrubbing material to be moved along the corner strap, for easily and quickly painting the corner strap by the users without specialized persons.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
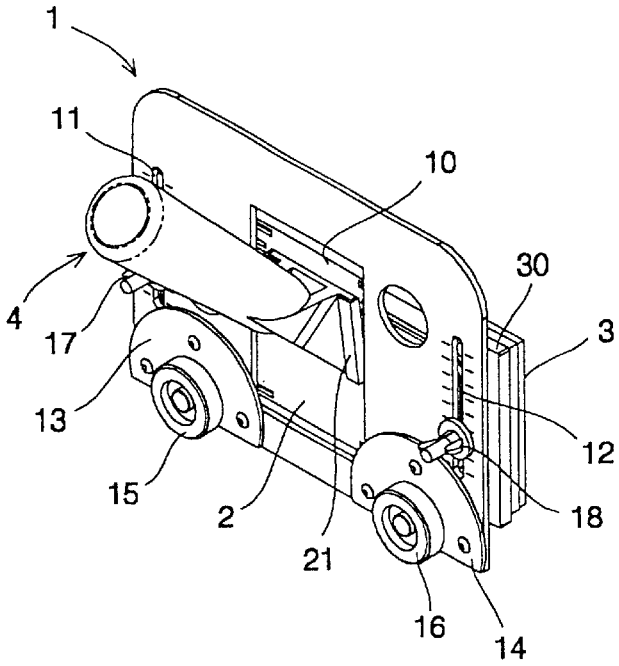
FIG. 1 is an upper perspective view of a painting device in accordance with the present invention.
Figure 2:
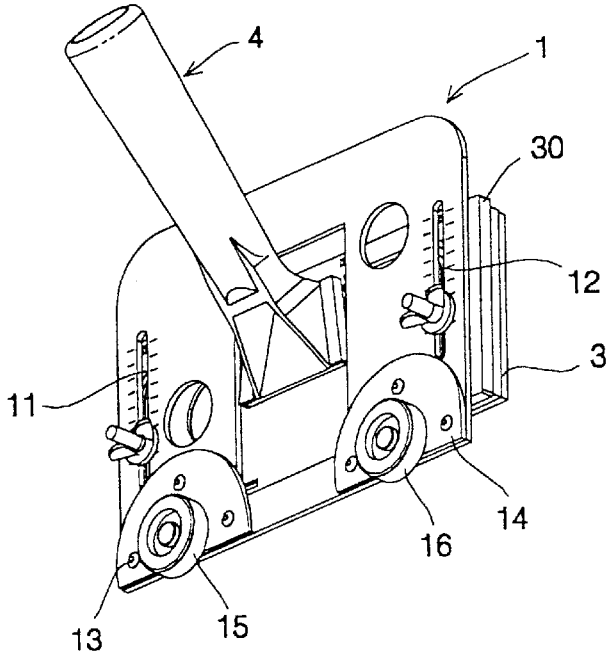
FIG. 2 is a bottom perspective view of the painting device.
Figure 3:
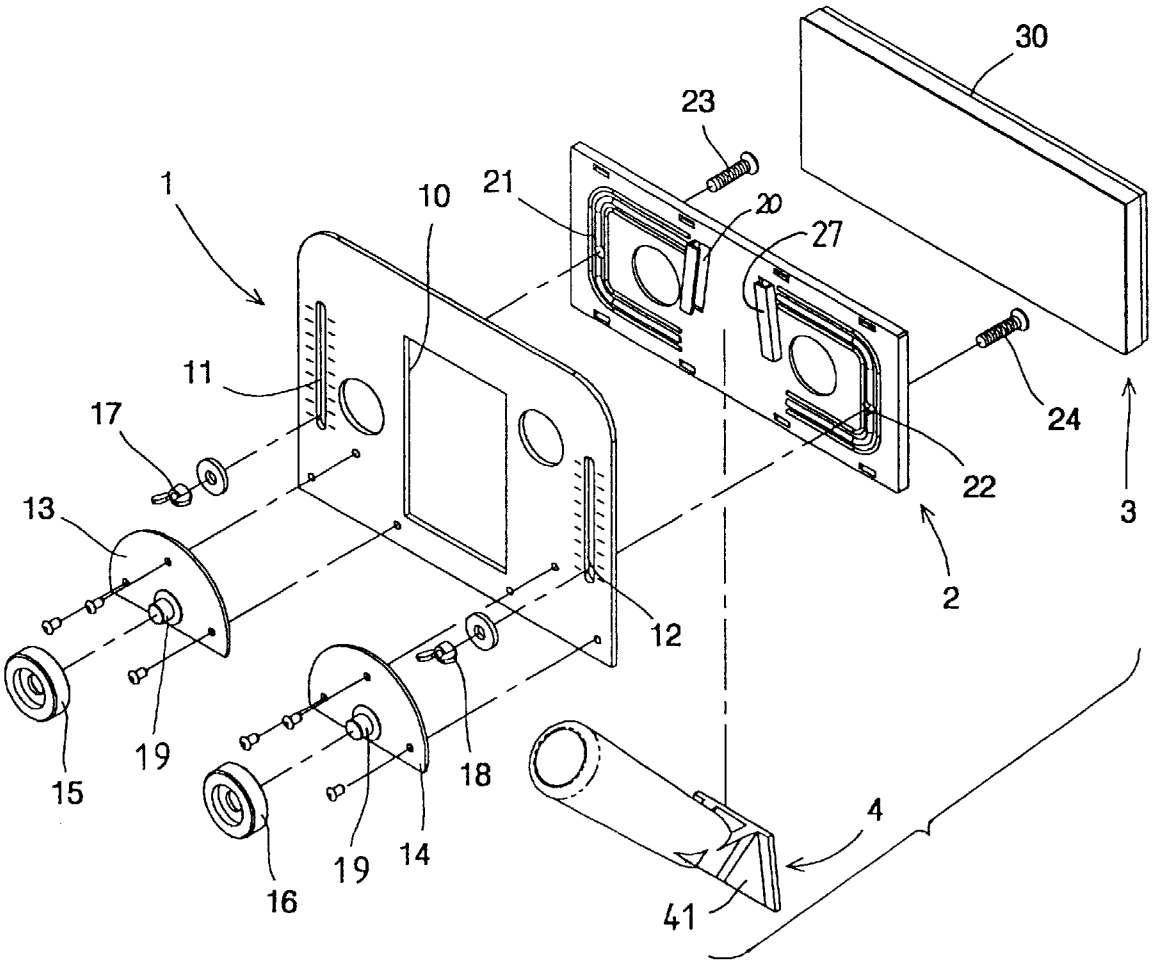
FIG. 3 is an exploded view of the painting device.
Figure 4:
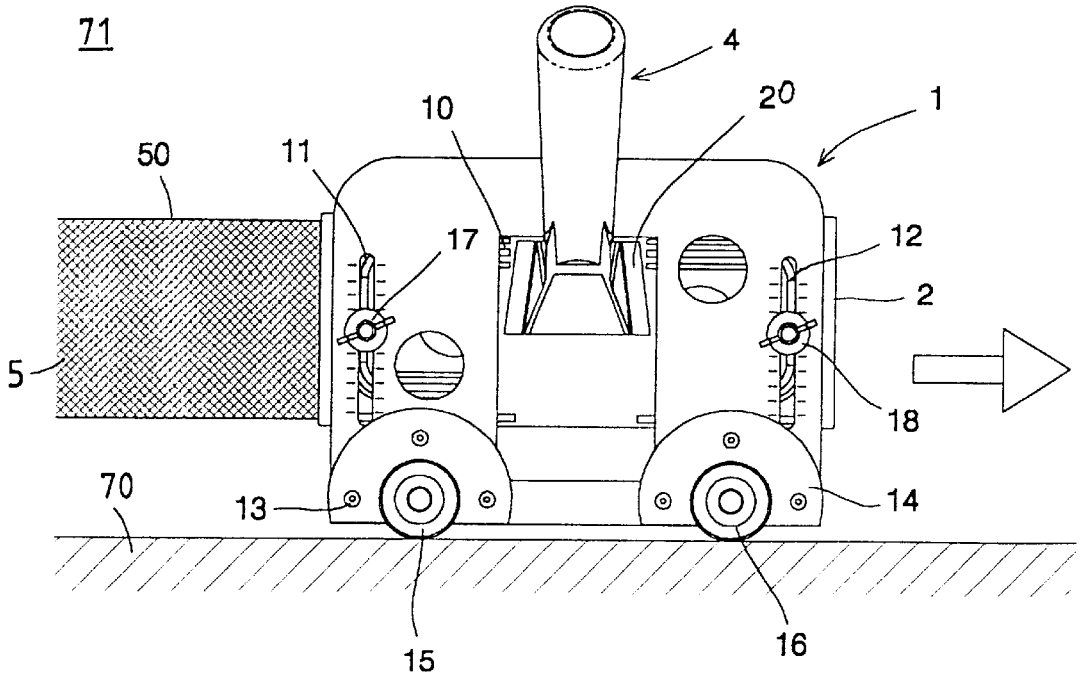
FIGS. 4, 5 are front schematic views illustrating the operation of the painting device.
Figure 5:
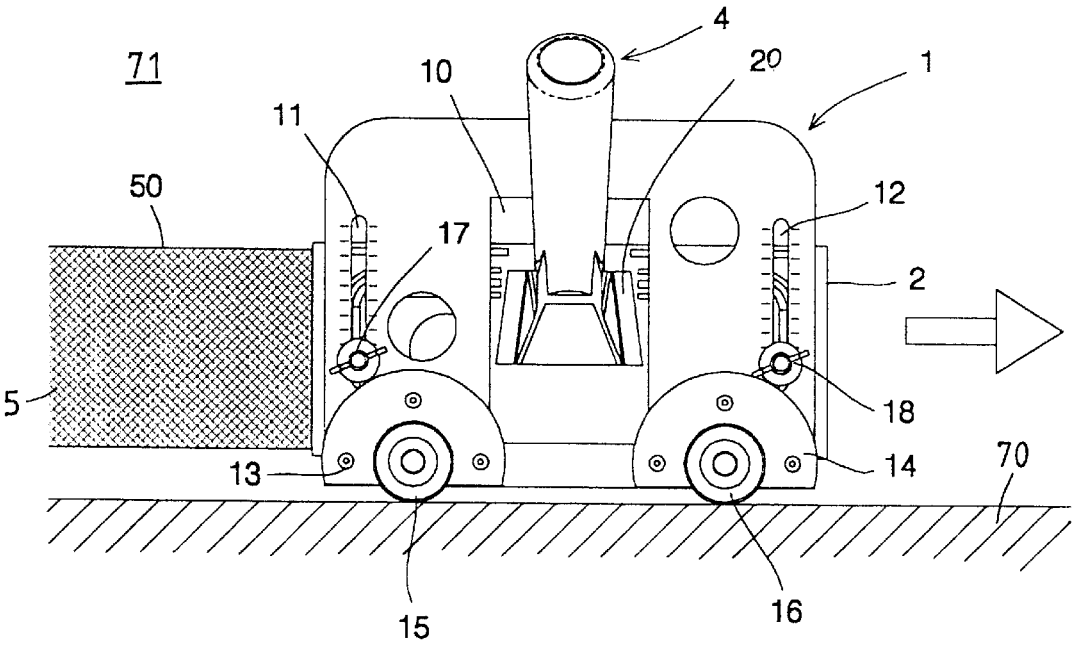
Figure 6:
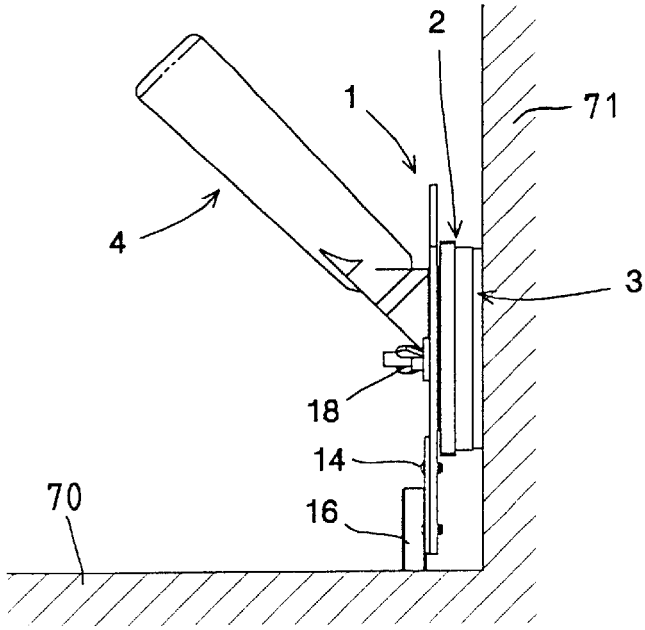
FIGS. 6, 7 are side schematic views illustrating the operation of the painting device.
Figure 7:
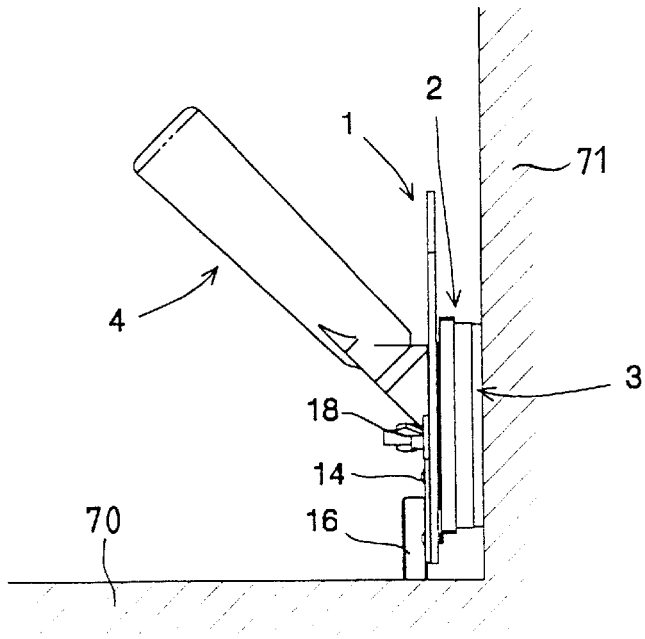
Figure 8:
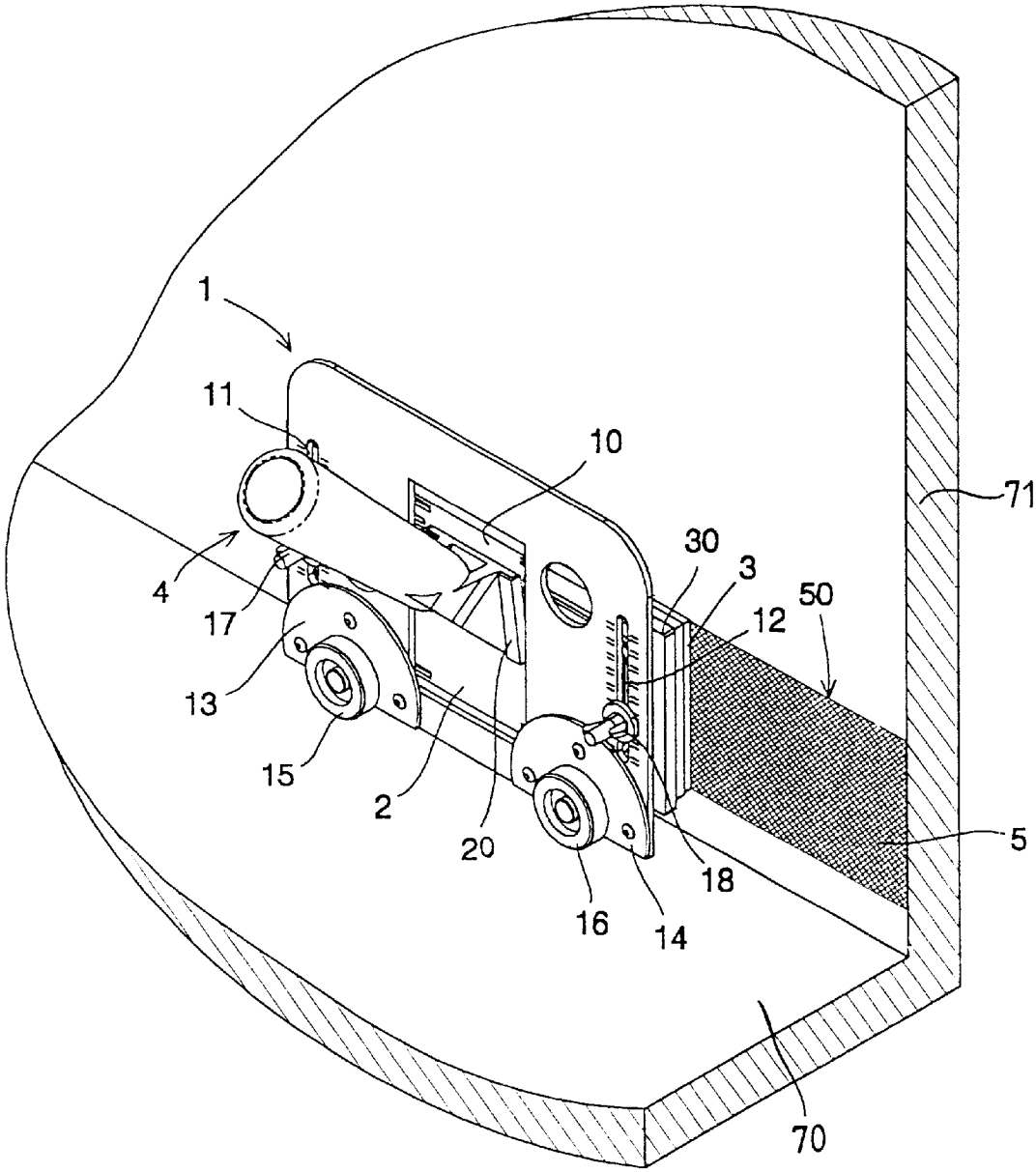
FIG. 8 is a perspective view illustrating the operation of the painting device.

Referring to the drawings, and initially to FIGS. 1–3, a painting device in accordance with the present invention comprises a board 1 including an opening 10 formed in the middle portion thereof, and including two grooves 11, 12 formed in the side portions thereof and extended vertically from the lower portion toward the upper portion of the board 1. One or more panels 13, 14 are secured to the bottom portion of the board 1 with such as the fasteners. One or more wheels 15, 16 are rotatably secured to the board 1, such as secured to the panels 13, 14 of the board 1 with pivot pins 19 respectively, and extended downward beyond the board 1 and/or the panels 13, 14 for engaging with the supporting surface, particularly the ground or the floor 70, and for allowing the board 1 to be moved on or along the floor 70 with the wheels 15, 16. The board 1 preferably includes one or more graduations provided beside each of the grooves 11, 12 thereof.

A plate 2 includes two side orifices 21, 22 formed therein for receiving fasteners 23, 24 respectively. The fasteners 23, 24 are slidably received or engaged in the grooves 11, 12 of the board 1, for guiding the plate 2 to move upward and downward relative to the board 1, and for allowing the plate 2 to be moved or adjusted upward and downward relative to the board 1. Two wing nuts 17, 18 or the like may be threaded with the fasteners 23, 24 and may be engaged with the board 1 for selectively or adjustably securing the plate 2 to the board 1. A scrubbing material 3, such as a sponge rubber, a rug, a scrub, or the like, is secured to the front portion of the plate 2 with such as the fasteners, adhesive materials, hook and loop devices, or the like, such that the scrubbing material 3 may be moved together with the plate 2 and the board 1.

The plate 2 includes a lock channel device 20 having such as two inclined L-shaped beams 27 disposed in the middle portion thereof and extended through or in the opening 10 of the board 1. A handle 4 includes a flap 41 provided on one end thereof and having the side portions for engaging into the beams 27 or into the lock channel device 20 for detachably securing to the plate 2, and for moving the plate 2 and the board 1 and the scrubbing material 3 along the corner of the buildings, for example.

In operation, as shown in FIGS. 4–8, the plate 2 and thus the scrubbing material 3 may be moved or adjusted up and down relative to the board 1 and thus relative to the floor 70 or relative to the wall member 71 by the wing nuts 17, 18, for allowing the scrubbing material 3 to be adjusted relative to the corner strap 5 that is normally disposed or provided in the bottom portion of the wall member 72, and for aligning the upper edge 30 of the scrubbing material 3 with the upper edge 50 of the corner strap 5. When the scrubbing material 3 has been adjusted relative to the corner strap 5 to the required position, the painting material may then be applied onto the scrubbing material 3, and the scrubbing material 3 may then be forced to engage with the corner strap 5 and to be moved along the corner strap 5 by the handle 4 and with the wheels 15, 16, such that the corner straps 5 may be easily painted by the users without specialized persons.

Accordingly, the painting device in accordance with the present invention may be used or provided for easily and quickly painting the corner straps of the houses or buildings by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A painting device comprising:

a board, a scrubbing material, means for securing said scrubbing material to said board, said scrubbing material being moved together with said board and provided for being applied with a painting material thereon, means for moving said board and said scrubbing material along a supporting surface, and means for adjusting said scrubbing material relative to said board, said adjusting means including at least one groove formed in said board, a plate secured to said scrubbing material, and at least one fastener secured to said plate and slidably received in said at least one groove of said board for adjustably securing said plate to said board.

2. The painting device according to claim 1, wherein said securing means includes a plate secured to said board for supporting said scrubbing material.

3. The painting device according to claim 2, wherein said board includes an opening formed therein, said moving means includes a handle engaged through said opening of said board and secured to said plate for moving said board and said scrubbing material along the supporting surface.

4. The painting device according to claim 1 further comprising wheel means for facilitating the moving of said board and said scrubbing material along the supporting surface.

5. The painting device according to claim 4, wherein said wheel means includes at least one wheel rotatably secured to said board and extended downward beyond said board for engaging with the supporting surface.

6. The painting device according to claim 4, wherein said board includes at least one panel secured thereto, said wheel means includes at least one wheel rotatably secured to said at least one panel and extended downward beyond said board for engaging with the supporting surface.

* * * * *